US008602536B1

(12) United States Patent
Sarnoff et al.

(10) Patent No.: US 8,602,536 B1
(45) Date of Patent: Dec. 10, 2013

(54) PROGRAMMING CUSTOMIZABLE SMART-CHIP IN AN INK REFILLING STATION

(75) Inventors: Herb Sarnoff, Carlsbad, CA (US); Jason Guhse, Poway, CA (US)

(73) Assignee: Retail Inkjet Solutions, Inc., Carlsbad, CA (US)

( * ) Notice: Subject to any disclaimer, the term of this patent is extended or adjusted under 35 U.S.C. 154(b) by 428 days.

(21) Appl. No.: 12/940,013

(22) Filed: Nov. 4, 2010

(51) Int. Cl.
*B41J 2/175* (2006.01)

(52) U.S. Cl.
USPC ..... 347/85; 347/86

(58) Field of Classification Search
USPC ..... 347/14, 15, 85–87
See application file for complete search history.

(56) References Cited

U.S. PATENT DOCUMENTS

2002/0030714 A1* 3/2002 Walker ..... 347/19
2007/0051421 A1* 3/2007 Sarnoff et al. ..... 141/83

* cited by examiner

*Primary Examiner* — Laura Martin
(74) *Attorney, Agent, or Firm* — Knobbe, Martens, Olson & Bear, LLP

(57) ABSTRACT

Embodiments provide a generic configurable Smart-chip for use in programming said Smart-chip on a remanufactured or refilled inkjet cartridge and for use with an inkjet cartridge refilling system. The system includes a programming station configured to program a configurable Smart-chip with information indicative, for example, of the color, size, and/or type of inkjet cartridge. The system may also include a filling station configured to provide any of a plurality of inks into the inkjet cartridge. The system may also include test capability that can be configured to test the configurable Smart-chip to determine whether it has been properly configured and is working properly. The Smart-chip identifies an inkjet cartridge to the host inkjet printer and, among functions, stores usage information that allows a printer to predict how much ink remains in the printer cartridge in order to inform the user when he/she is likely to need a replacement inkjet cartridge.

32 Claims, 12 Drawing Sheets

PROGRAMMING CUSTOMIZABLE SMART-CHIP IN AN INK REFILLING STATION

BACKGROUND OF THE INVENTION

1. Field of the Invention

This invention relates to systems for refilling inkjet printer cartridges. More specifically, this invention relates to an integrated system that includes a series of stations and methods for writing data to a customizable Smart-chip in order to configure the Smart-chip to be properly recognized in an inkjet printer and thus to maintain functionality provided by a properly configured Smart-chip.

2. Description of the Related Art

In the personal and business computer market, inkjet printers are very common. Inkjet printers are inexpensive, quiet, fast and produce high quality output. However, replacement cartridges can be expensive. Although some manual inkjet refilling kits are available, they can be difficult and messy for individuals to use, and inkjet printer cartridges may become damaged during the refilling task, especially when performed by inexperienced users. Many inkjet cartridges use Smart-chips to control ink usage and other parameters of the inkjet cartridge and to properly identify an inkjet cartridge to the inkjet printer. A Smart-chip is an active electronic device that resides on an inkjet cartridge and communicates information, generally bi-directionally, with the inkjet printer and stores and provides various pieces of information about the inkjet cartridge and inkjet cartridge status to and from the inkjet printer. In order to achieve sufficient functionality, inkjet cartridge remanufacturers are often required to reset or replace these Smart-chips installed on the inkjet cartridges when an inkjet cartridge is refilled by the remanufacturer. Resetting a Smart-chip refers to the action of restoring the Smart-chip, and its various memory and other elements, to a state in which the printer will accept the replacement cartridge (with a reset Smart-chip) as if it were essentially the same as it would expect for a new replacement OEM inkjet cartridge. When resetting of a Smart-chip is not possible, a remanufacturer must replace the Smart-chip with an aftermarket Smart-chip that has the required functionality. The remainder of this specification will disclose an improved method for replacing Smart-chips on inkjet cartridges. Replacing such Smart-chips enables the cartridge to be refilled with ink when empty and, with this Smart-chip having been replaced, to perform substantially the same as a new cartridge. Such replacement Smart-chips have been available to assist in the inkjet cartridge remanufacturing industry for many years.

Original equipment manufacturers (OEMs) of printer and imaging products, such as Lexmark®, Canon®, Hewlett Packard® and the like, make the replacement inkjet cartridges that fit their respective inkjet printers. Each printer manufacturer designs its printers to accept inkjet cartridges manufactured by it, and oftentimes designs electronic devices, commonly referred to as Smart-chips, into the cartridge to insure proper functionality of the inkjet cartridge in the printer. These Smart-chips also generally serve to lockout replacement or aftermarket inkjet cartridges that were refilled or remanufactured by others. By reverse engineering these Smart-chip designs, solutions to either reset or to make an aftermarket equivalent Smart-chip have been developed.

Many customers prefer to refill their own printer cartridges in order to save costs. However, such refilling operations have been hampered because such refilled cartridges may not operate properly in a printer because the printer checks for the status of certain data within the Smart-chip on the inkjet cartridge, and which data can be unacceptable to the printer's firmware after refilling a previously emptied inkjet cartridge. Printer manufacturers also prefer to sell new inkjet cartridges to replace empty cartridges. Therefore, they do not generally support the remanufacturing industry for printer cartridges, for example, by providing the capability and methodology to reset these Smart-chips when a cartridge is refilled or by providing replacement Smart-chips. Thus, companies such as Microtec Technology Printing Co. (Guangdong, China), Static Control Components (North Carolina, USA) and Well Da Elec-Technology Co., Ltd (Shenzen, China) now manufacture Smart-chip resetting tools and/or replacement Smart-chips that either reset a Smart-chip to a like-new state or mimic the original Smart-chip on an inkjet cartridge and thus enable an inkjet cartridge to be refilled by a refilling machine and/or company differing from the original manufacturer. Such a replacement Smart-chip enables the cartridge to be re-filled with ink when empty and, with this replacement Smart-chip having been installed, to perform substantially the same as a new cartridge.

Generally, a unique Smart-chip is developed for each specific model and color of inkjet cartridge. Each unique cartridge type or model has a specific Smart-chip and specific stock keeping unit ("SKU") to distinguish one cartridge from another. This also means that each and every unique inkjet cartridge SKU generally requires its own unique replacement Smart-chip SKU. Within a given series or family of cartridges, for example those used together in a printer, there are often many unique cartridge SKUs, thus resulting in many unique Smart-chip SKUs. For example, inkjet cartridges within a family or series can vary by color, amount of ink or other key parameters. In some embodiments, the colors are yellow, black, cyan and magenta. In other embodiments, there are more colors, for example, black, cyan, magenta, yellow, light cyan, light magenta, gray and light gray.

Additionally, each color and type of cartridge may be available in one or more ink capacities or ink volume, for example, normal and extra large. The result of all of these variations in inkjet cartridge SKUs is that a remanufacturer must maintain a large inventory of each unique Smart-chip SKU and must also develop processes to account for and install this wide variety of virtually identical Smart-chip SKUs. For example, for the Hewlett Packard HP02 inkjet cartridge family, twelve unique Smart-chip SKUs are required to support the entire family or series—one for each of the six colors and with each color having two unique ink volume cartridge SKUs.

In a retail store environment for remanufacturing of inkjet cartridges, this Smart-chip SKU proliferation and related issues are multiplied by the number of retail locations and the number of operators that are performing refill operations. For example, each site will require inventory of each Smart-chip SKU, along with processes for distinguishing between and installing these many Smart-chip SKU types that are understandable to the many operators at each retail site location. For a retail chain with hundreds or even thousands of locations, the impact of a large number of replacement Smart-chip SKUs can therefore be very significant.

SUMMARY

One embodiment is a system for refilling an inkjet cartridge. The system includes a first station configured to refill an inkjet cartridge, a second station configured to electrically connect to a configurable Smart-chip on the inkjet cartridge, and programmed instructions that when executed store inkjet cartridge configuration data on the configurable Smart-chip.

In one embodiment, the programmed instructions are configured to validate the configuration data stored on the configurable Smart-chip. In one embodiment, the second station is configured to mate with an adapter that holds and electrically connects to the inkjet cartridge or else can be configured to electrically mate directly to the inkjet cartridge's Smart-chip. In another embodiment, the system includes a receiver adapted to mate with the adapter and thus provide an electrical connection from the system to the configurable Smart-chip on the inkjet cartridge. The system may also include a graphical user interface configured to receive inputs from a user to determine the specific configuration requirements for the inkjet cartridge and a controller configured to execute the programmed instructions. The inkjet cartridge configuration data may include data indicative of at least one of the size, color and/or type of inkjet cartridge. In one embodiment, the second station automatically starts when the cartridge is detected. In one embodiment, the first station comprises a nozzle filling station and may further include a plurality of ink supply needles.

Another embodiment is a configuration system for inkjet cartridges including one or more adapting means for electrically connecting to an inkjet cartridge, each of the adapting means configured to electrically connect to a Smart-chip on an inkjet printer cartridge and wherein each inkjet cartridge includes a Smart-chip that is configurable to one of multiple possible configurations, one or more receiving means for electrically connecting to the one or more adapting means, wherein each of the adapting means is configured to be individually mounted into and demounted from said receiving means and one or more means for storing data on said Smart-chip indicative of the size, color and/or type of inkjet cartridge. In one embodiment, the inkjet cartridge refill system further includes a validating means for confirming the configuration of the Smart-chip was executed properly. In yet another embodiment, the adapting means comprises an adapter configured to mate with one or more inkjet cartridges. In another embodiment, the adapting means comprises an open slot configured to receive one or more inkjet cartridges. In one embodiment, the receiving means comprises a receiver configured to receive the adapting means. In another embodiment, the means for configuring the Smart-chip comprises electronics connected to the receiving means.

Yet another embodiment is a method for installing a Smart-chip on an inkjet cartridge. This method includes providing a Smart-chip that is configurable to one of multiple configurations, providing an inkjet cartridge that requires a Smart-chip to achieve specific functionality, installing the Smart-chip onto said inkjet cartridge, and configuring said Smart-chip into one of multiple possible configurations. In one embodiment, the specific configuration is one which corresponds to a particular cartridge type. In one embodiment, the Smart-chip is pre-loaded with a generic code to provide base functionality and that enables the configuration process. In one embodiment, the configuring is done within forty-eight hours of installing the Smart-chip onto the printer cartridge. In one embodiment, the Smart-chip is attached to the cartridge prior to being configured. In yet another embodiment, the Smart-chip is configured prior to being attached to the cartridge. In one embodiment, there are at least three possible configurations of Smart-chip SKUs from the one generic customizable Smart-chip.

In one embodiment, the Smart-chip communicates with a printing system when the cartridge is installed in said system. In yet another embodiment, the method of configuring involves communicating with the Smart-chip. In yet another embodiment, the Smart-chip is communicated to via an electrical connection. Communicating with the Smart-chip includes writing data and/or other instructions to the electronic storage on the Smart-chip indicative of at least one of the type of inkjet cartridge, a color, and/or cartridge size.

Still another embodiment is a method for refilling an inkjet cartridge. This embodiment includes electrically connecting to a programmable storage on the inkjet cartridge via a first station, executing programmed instructions to store inkjet cartridge configuration data on a programmable storage of the Smart-chip, and refilling an inkjet cartridge via a second station according to the programmed instructions. In one embodiment, the method also includes validating the configuration data stored on the programmable storage of the Smart-chip. In one embodiment, the method also includes mating the first station with an adapter that holds the inkjet cartridge. In one embodiment, the method also includes adapting a receiver to mate with the adapter and provide an electrical connection from the system to the programmable storage-of the Smart-chip on the inkjet cartridge.

The system, method, and devices of the invention each have several aspects, no single one of which is solely responsible for its desirable attributes. Without limiting the scope of this invention as expressed by the claims which follow, its more prominent features will now be discussed briefly. After considering this discussion, and particularly after reading the section entitled "Detailed Description of Certain Embodiments" one will understand how the features of this invention provide advantages that include more efficient and environmentally friendly refilling of inkjet cartridges.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION

Figure 1:
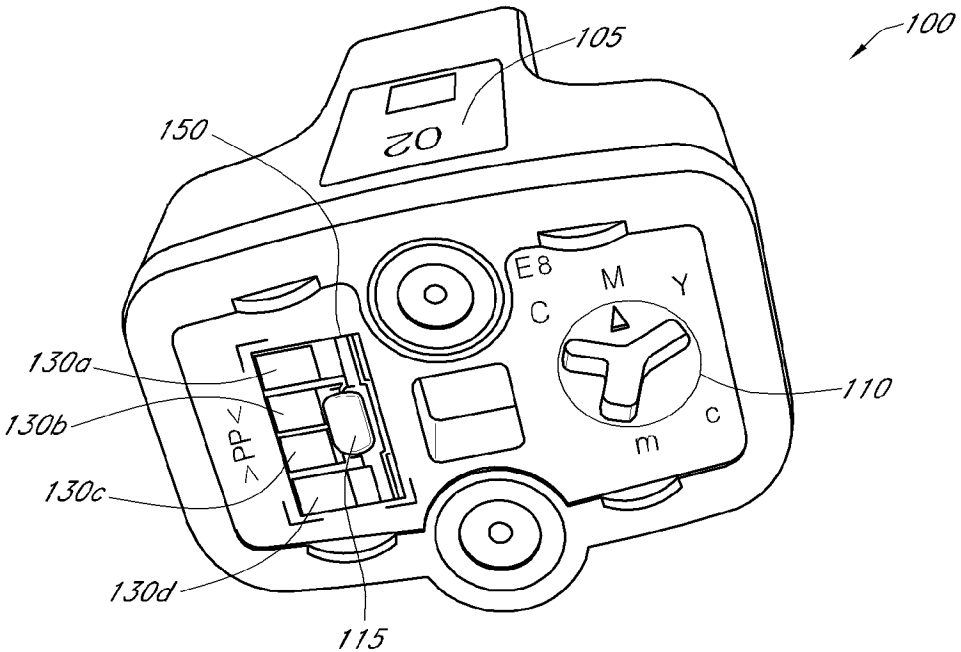
FIG. 1 is an embodiment of a typical inkjet cartridge that has an electronic Smart-chip.

Embodiments of the invention relate to a cartridge refilling system for electronic devices, for example, an inkjet printer. References to inkjet printers are intended to include laser printers and other devices using an ink or toner source capable of being replaced or refilled. References to inkjet cartridges are also intended to include toner cartridges, LED printing supplies and other consumables that include a configurable Smart-chip. Likewise, references to an inkjet cartridge refilling system are intended to include refilling devices for any type of imaging product capable of being replaced or refilled.

One embodiment is a system and method that includes one or more configurable Smart-chips that can be used with a plurality of different types of inkjet printer cartridges. For example, one generic configurable Smart-chip may be configurable so that it can be attached and used with any inkjet printer cartridge within a given family or series of inkjet cartridges. To remanufacture an inkjet cartridge with a Smart-chip, a used inkjet printer cartridge is refilled and then a generic configurable Smart-chip would replace the original Smart-chip on the inkjet cartridge. The generic configurable Smart-chip is then programmed to have the proper configuration data so that the generic configurable Smart-chip emulates the specific Smart-chip SKU that would otherwise be used for the inkjet printer cartridge SKU that is being refilled. Writing configuration data to the configurable Smart-chip at the time of refilling the cartridge prevents a user from having to store and maintain inventory of Smart-chips for every unique Smart-chip SKU needed to support the inkjet cartridge SKUs being sold. Of course, it should be realized that the Smart-chip can be programmed either before refilling the inkjet cartridge, during the refilling process, or after refilling the inkjet cartridge without departing from the spirit of the invention.

In one embodiment, the generic configurable Smart-chip is assembled onto an inkjet printer cartridge, and then the cartridge is mounted into an inkjet cartridge refilling system that is capable of writing configuration information to the Smart-chip. In one embodiment, the system has a plurality of stations for refilling an inkjet printer cartridge as described in U.S. Pat. No. 7,540,597, issued Jun. 2, 2009, which is incorporated by reference in its entirety. In one embodiment, the system includes a Smart-chip programming station for programming a customizable Smart-chip on the inkjet cartridge.

Printers generally communicate with the Smart-chips on an inkjet cartridge, among other reasons, to determine if the correct cartridge has been installed, to determine which size cartridge has been installed, to identify the specific serial number or other identifying information of that inkjet cartridge for tracking purposes, and to store usage or other process or status information about that particular inkjet cartridge. That usage information, for example, may be what allows a printer to predict how much ink or toner remains in the printer cartridge in order to inform the user when a replacement cartridge is needed. In one example, the Smart-chip is accessed to determine how much ink remains in the inkjet cartridge. Practically speaking, however, this functionality is quite inaccurate, and this indicator of the ink supply information is largely ignored by the user of the printer as to deciding when to replace an inkjet cartridge that is running low on ink. A user instead opts to wait until an inkjet cartridge runs empty and the print quality begins to degrade before replacing the spent inkjet cartridge.

Furthermore, each inkjet cartridge in a given series, with a series being defined as several cartridges that are essentially the same cartridge but with each cartridge in the series having a unique amount of ink, or a unique ink color, or some other unique characteristic, and thus likely to have its own unique Smart-chip SKU. Generally the physical and electrical characteristics of each Smart-chip SKU within a series will be substantially the same, with generally only a programming or configuration difference between them. Thus, in order to avoid having a significant number of unique Smart-chip SKUs, embodiments of the invention provide a system that can conveniently customize, at the time that a spent cartridge is refilled or remanufactured, a Smart-chip, that is developed to work for an entire series of cartridges.

In one embodiment, remanufacturers of inkjet cartridges not only refill the ink in an inkjet cartridge so that it maintains the print quality of a new inkjet cartridge, but also modify, reset or replace the Smart-chip associated with the inkjet cartridge so that the inkjet cartridge behaves with the same or similar functionality to a new inkjet cartridge. In one example, the Smart-chip is programmed so that a printer reading the Smart-chip receives data indicating that the cartridge is full or otherwise ready to function as a new inkjet cartridge would. If the Smart-chip is not reset or replaced upon refilling an inkjet cartridge, the printer may display warning messages about "running low on ink" to the person using the printer. Thus, in one embodiment, the Smart-chip on an inkjet cartridge is programmed or configured to make sure a printer receives the proper communication from the inkjet cartridge to know that the refilled cartridge is full, or otherwise receives from the inkjet cartridge information that the printer is expecting of a new inkjet cartridge of that particular type. To do this, the cartridge OEM Smart-chips generally need to be either reprogrammed, for example usage data can at times be reset to "as new" status, or replaced altogether with a Smart-chip that imitates the function of the original OEM Smart-chip, providing the correct responses to the printer's data requests, and with the ability to store usage or other information in the same way that the OEM Smart-chip does. In other embodiments, the replacement Smart-chip includes data that allows the inkjet cartridge to be properly recognized by the printer.

One example of a refillable ink jet cartridge 100 is shown in FIG. 1. Information indicative of the cartridge is shown on the bottom side of the cartridge, for example, the type 105 of cartridge, in this case, an HP02 (standard volume) Ink Cartridge from the Hewlett Packard® Company, and the color 110, in this embodiment magenta, is shown by the color of the housing and the shape of a symbol embossed on the cartridge 100. In this example, the Smart-chip 150 comprises the Smart-chip electronics 115 consisting of active electronic components generally mounted on a printed circuit assembly (PCA), and four connection pads 130*a-d* to communicate to the printer or to the Smart-chip configuration device. This system is described in more detail, below.

In one embodiment, the system and method utilizes a generic, configurable Smart-chip along with a process to configure or program that Smart-chip via electronic communication to become one of many unique Smart-chip types (i.e. based on color, ink volume, type, etc.), and to do so at the point of remanufacture of the inkjet cartridge.

In one embodiment, the system employs a process of installing a generic Smart-chip onto a cartridge, then programming or configuring that Smart-chip for the specific inkjet cartridge SKU being remanufactured. In one embodiment, the programming of the Smart-chip occurs before installing it on the cartridge. By using the embodiments described herein only one generic Smart-chip is needed for a given family or series of cartridges at the point of remanufacture of the inkjet cartridge. This eliminates the need to maintain inventory of each unique Smart-chip SKU for that family or series of inkjet cartridge SKUs.

In one embodiment, a generic adapter is employed for a given family or series of inkjet cartridges that allows the generic Smart-chip alone, or the inkjet cartridge with a generic Smart-chip already installed, to be inserted into the generic adapter. The generic adapter can then be connected to a receiving device through an electrical interface that allows for the programming or configuration of the Smart-chip to convert the Smart-chip into a unique Smart-chip SKU within that family or series of inkjet cartridge. This results in converting the remanufactured inkjet cartridge into the specific configuration required to be installed correctly into, and recognized properly by, the appropriate inkjet printer.

In one embodiment, the cartridge couples directly with the second station of the refill system without the need for an adapter. In one embodiment this is accomplished via a fixed slot in the second station of the refill system to receive the cartridge.

As one advantage, the system and method developed requires only a fraction of the number of Smart-chip SKUs, and thus vastly reduced inventory of Smart-chips, when compared to the traditional method for solving this problem which is to maintain a sufficient inventory of each Smart-chip SKU. By reducing the number of SKUs of replacement Smart-chips, the total required inventory of Smart-chips is also substantially reduced. Overall, there can be an order of magnitude (i.e. 10×) improvement in the inventory management of Smart-chips for certain cartridge families or series.

In an additional advantage, because there is no need to discern between many similar looking Smart-chips (perhaps the only difference being a marking on a very small PCA), there is reduced risk of putting the wrong replacement Smart-chip onto an inkjet cartridge being remanufactured. By installing one generic Smart-chip, then programming or configuring that Smart-chip, it is also assured that the Smart-chip was installed in the right orientation (e.g. if the Smart-chip were installed improperly, the Smart-chip would not be configurable or programmable due to the lack of proper electrical connection).

Other embodiments are further directed to a computer-readable medium, in which a program or data is recorded, the program or data being used to write specific configuration or other electronic information into a configurable Smart-chip for an inkjet cartridge. The specific configuration or other information can include, but is not limited to, information relating to a quantity of ink kept or remaining in the inkjet cartridge, the type of inkjet cartridge, the size or volume of the inkjet cartridge, and/or the color of the ink in the inkjet cartridge. The configuration of a generic Smart-chip on an inkjet cartridge can include a program code that causes a computing device to write data indicative of the various inkjet cartridge properties onto a memory on the Smart-chip. The program code may also cause the computing device to write write-complete information into a write-complete information storage area, which is provided corresponding to the information memory division(s) in the Smart-chip.

Figure 2A:
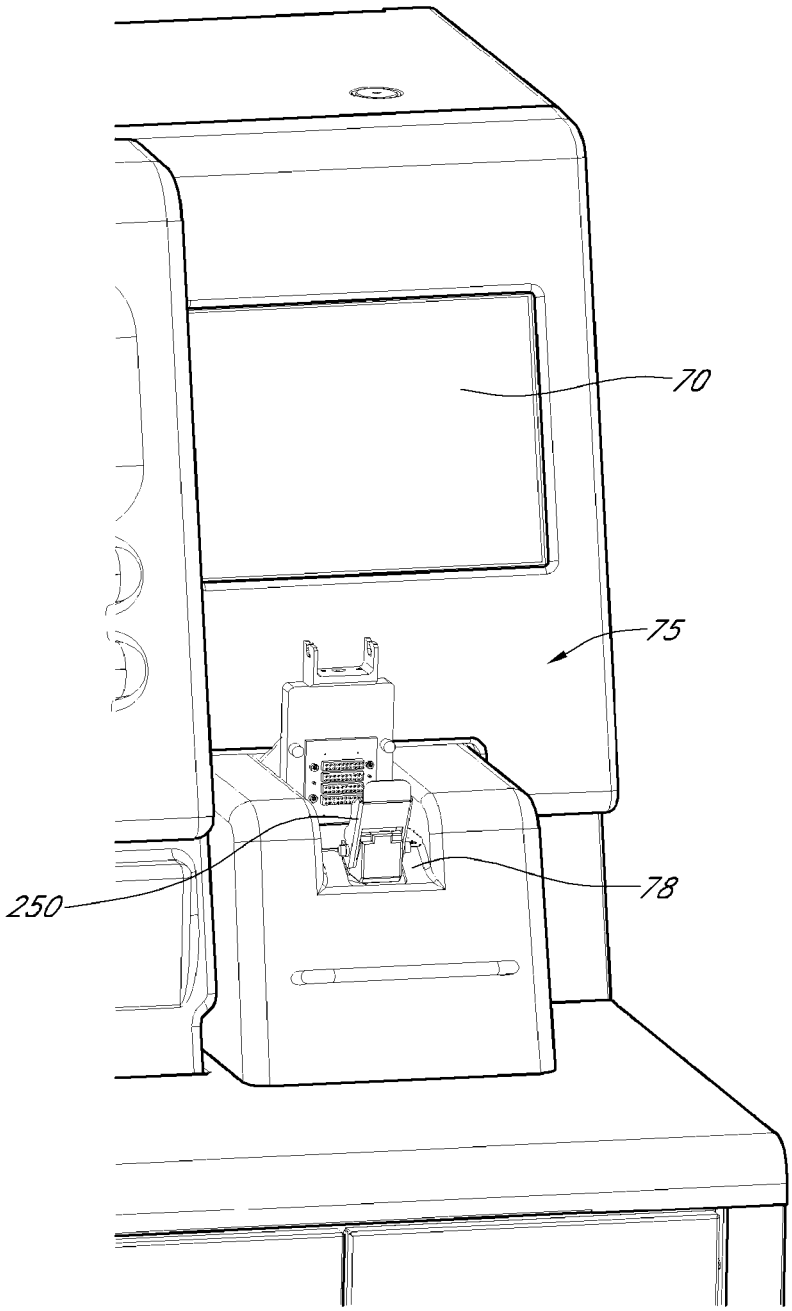
FIG. 2A is an embodiment for an inkjet printer cartridge Smart-chip programming station.
Figure 2B:
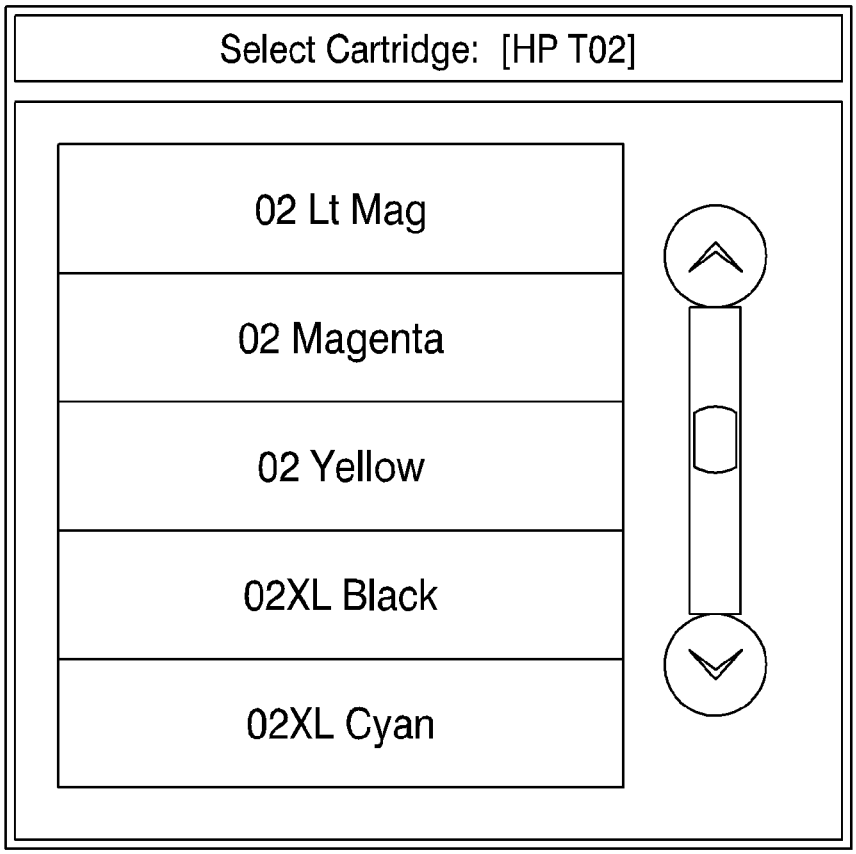
FIGS. 2B and 2C are embodiments of a graphical user interface to the inkjet printer cartridge Smart-chip programming station shown in FIG. 2A.
Figure 2C:
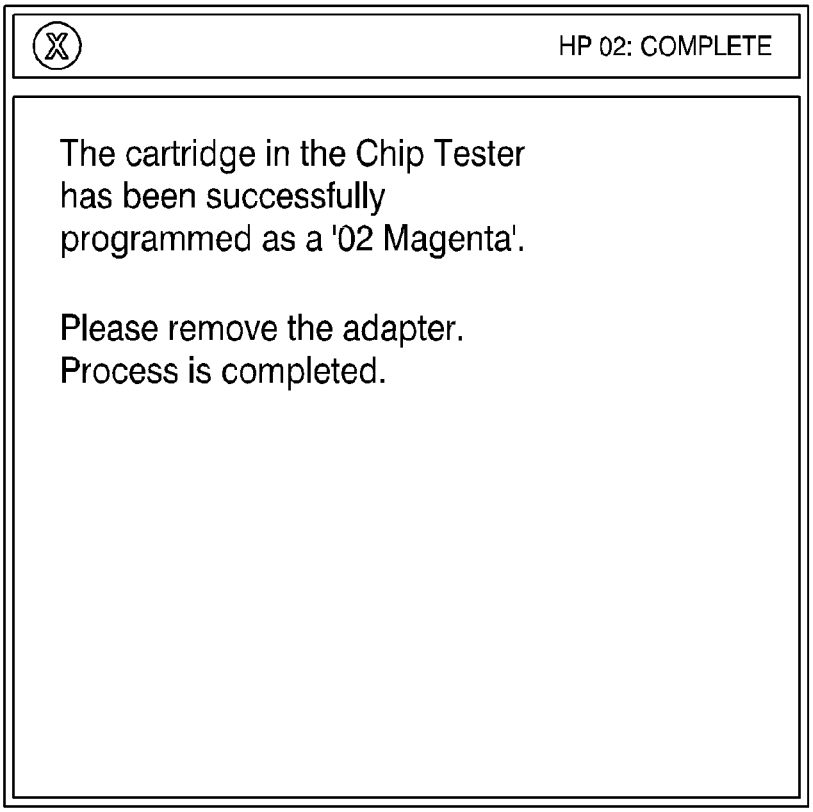

Before or after an inkjet cartridge is introduced to the refilling system 10, the inkjet cartridge is configured for refilling via a Smart-chip programming station 75 shown in FIG. 2A. The Smart-chip programming station 75 is electrically linked to a display 70 that shows a graphical user interface for an operator to interact with the system and to select the customization or programming that is required for a specific Smart-chip or cartridge SKU or other required operation. The graphical user interface also facilitates communication between the operator and the refilling system 10 and the inkjet cartridge, for example, to confirm the current configuration of the inkjet cartridge. The graphical user interface is shown more specifically with reference to FIGS. 2B, 2C, 4 and 5 below.

The graphical user interface is configured to allow the operator to select the desired configuration or programming of the generic Smart-chip that is required for a specific inkjet cartridge SKU and to prepare the inkjet cartridge for eventually being inserted back into an inkjet printer.

Instructions within the system 10 also provide the step of validating that the Smart-chip programming or configuration was done properly and to inform the refill system operator that the process was completed properly, thereby providing one means by which the configuration of the Smart-chip is validated. This is confirmed through the graphical user interface, as described above and shown, for example, in FIG. 2C.

Method for Programming the Smart-Chip

Figure 3:
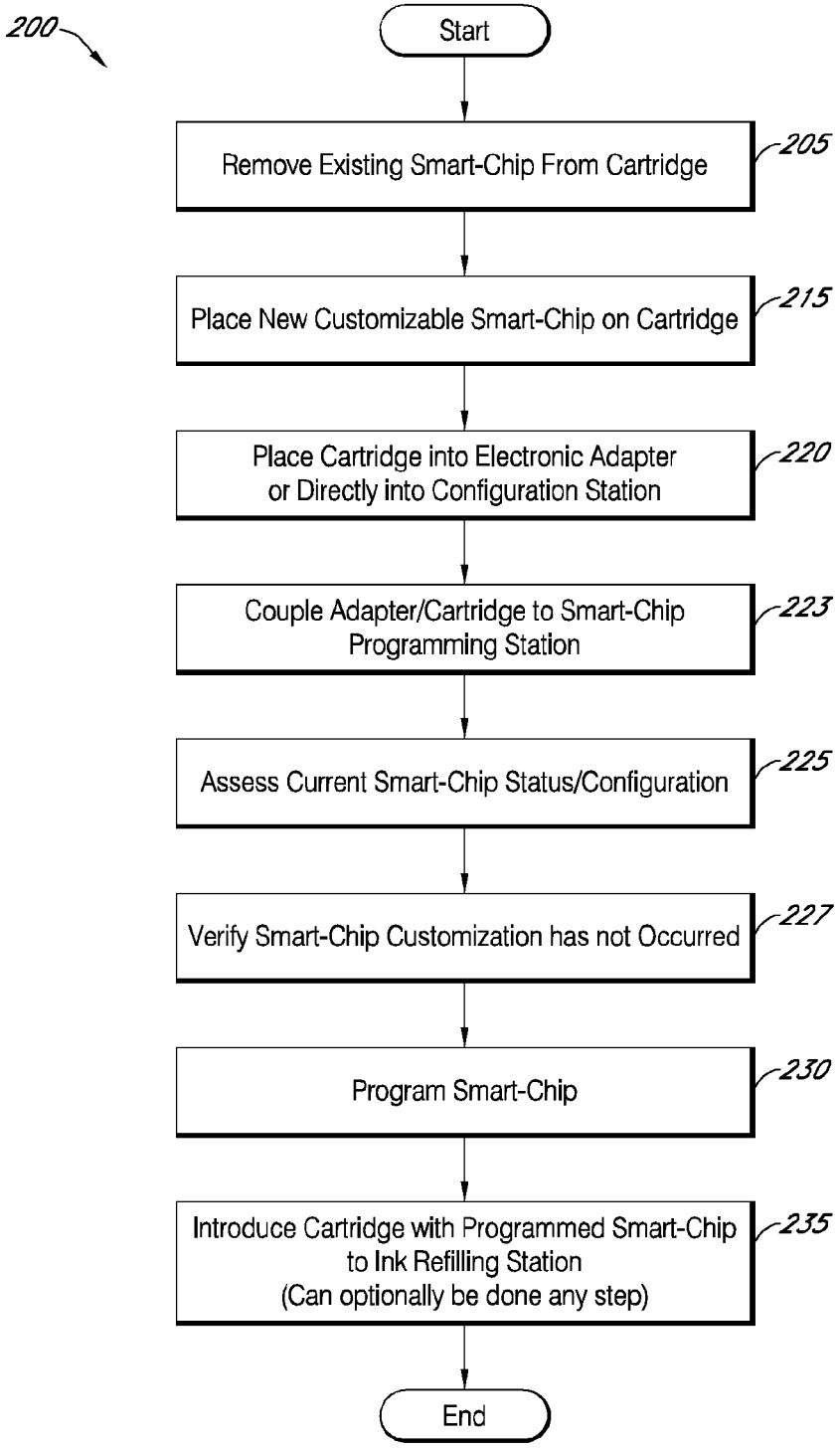
FIG. 3 is a flow diagram of one embodiment of a method for programming a configurable Smart-chip for an inkjet cartridge.

Referring now to FIG. 3, a flowchart of an embodiment of one method for programming a configurable Smart-chip and refilling inkjet cartridges is shown. The method 200 as described herein may be employed prior to using the refilling system 10 as described below and shown in FIG. 7; however, the order of this sequence can be reversed, with the refilling system 10 being utilized prior to, or in between, any of the Smart-chip programming or configuration steps. In some embodiments, one goal of the Smart-chip configuration or programming process 200 is to configure the generic Smart-chip, but in other embodiments the method may be used to download a portion of or the complete electronic program required for that particular Smart-chip SKU to function properly and then, if required, to further configure said Smart-chip SKU, and finally, if desired, to test whether the inkjet cartridge Smart-chip is configured and/or functioning as expected. One object of the invention is also to provide a method of writing the required pieces of information relating to the ink cartridge into the ink cartridge via a customizable generic Smart-chip comprising at least an electronic storage element, the ability to communicate electronically and being mounted onto the ink cartridge either before or after being refilled but before being installed into an inkjet printer.

In one embodiment, the system and method described below is an integrated part of the refilling system 10. In other embodiments, the system and method 200 of programming station 75 are separate or standalone from the system 10.

The process 200 starts at block 205 where a vacuum source or a mechanical tool or other means is employed to remove the existing Smart-chip package 150 from the cartridge 100. In some embodiments this is done manually. In other embodiments, the Smart-chip removal is done with assistance from the system 10.

Moving to block 215, a new configurable generic Smart-chip is secured onto the inkjet cartridge 100. In one embodiment, the Smart-chip is secured with adhesive. In another embodiment, the Smart-chip is snapped or otherwise mechanically attached into place on the inkjet cartridge 100. In one embodiment, the configuration of the Smart-chip is done within forty-eight hours of installing the Smart-chip onto the printer cartridge. It is important that the Smart-chip be aligned and positioned within a certain tolerance band so that the electrical connections 130*a-d* line up properly between the Smart-chip and the Smart-chip programming station 75 of the refilling system 10 or of the electronic programming adapter 250.

Figure 6A:
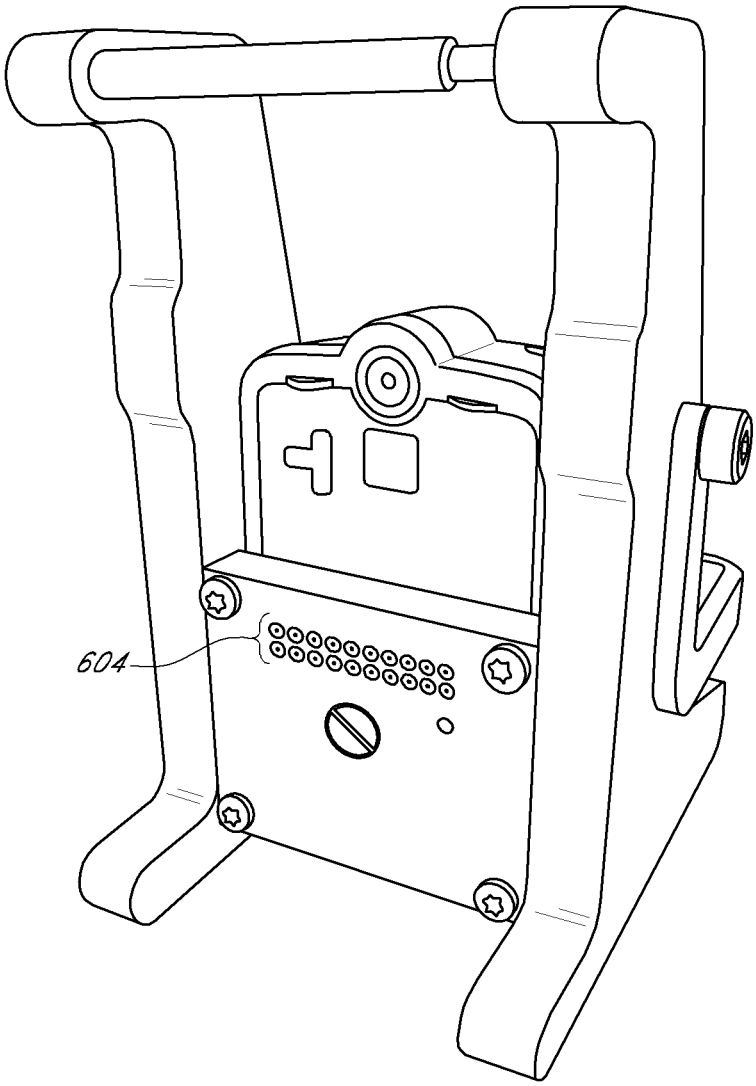
FIGS. 6A-C illustrate various views of embodiments of adapters for coupling an inkjet printer cartridge with the Smart-chip programming station.
Figure 6B:
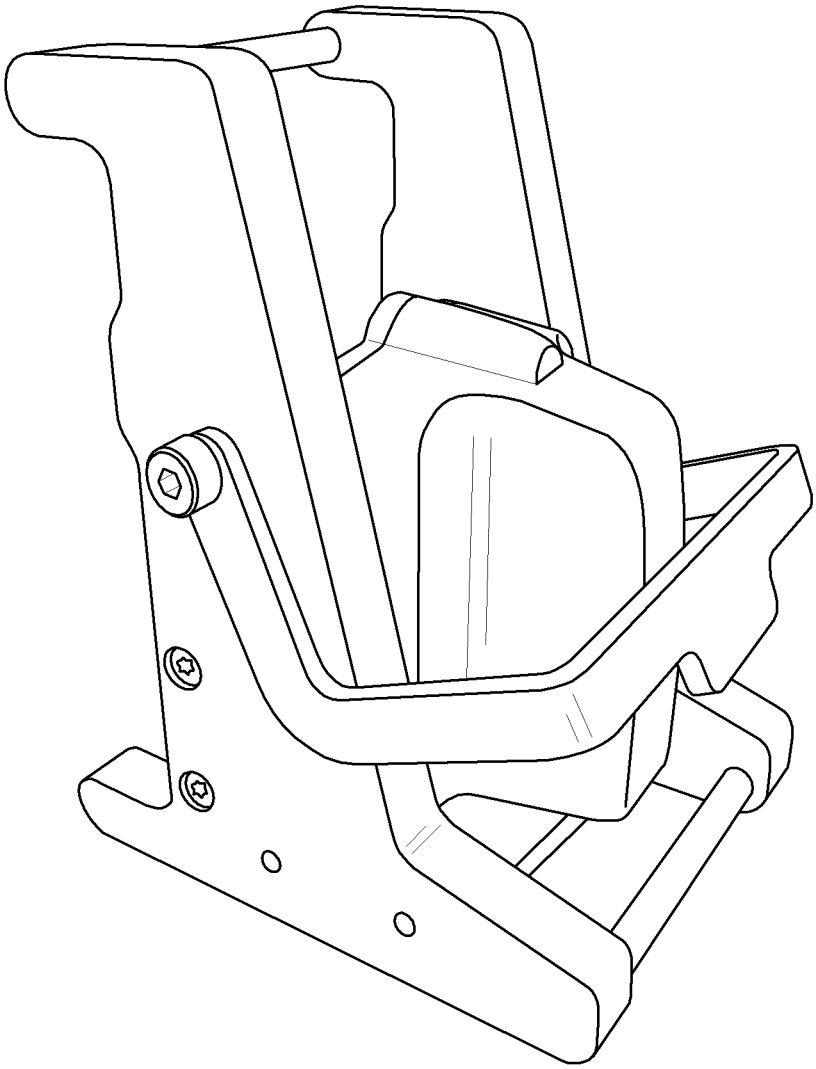
Figure 6C:
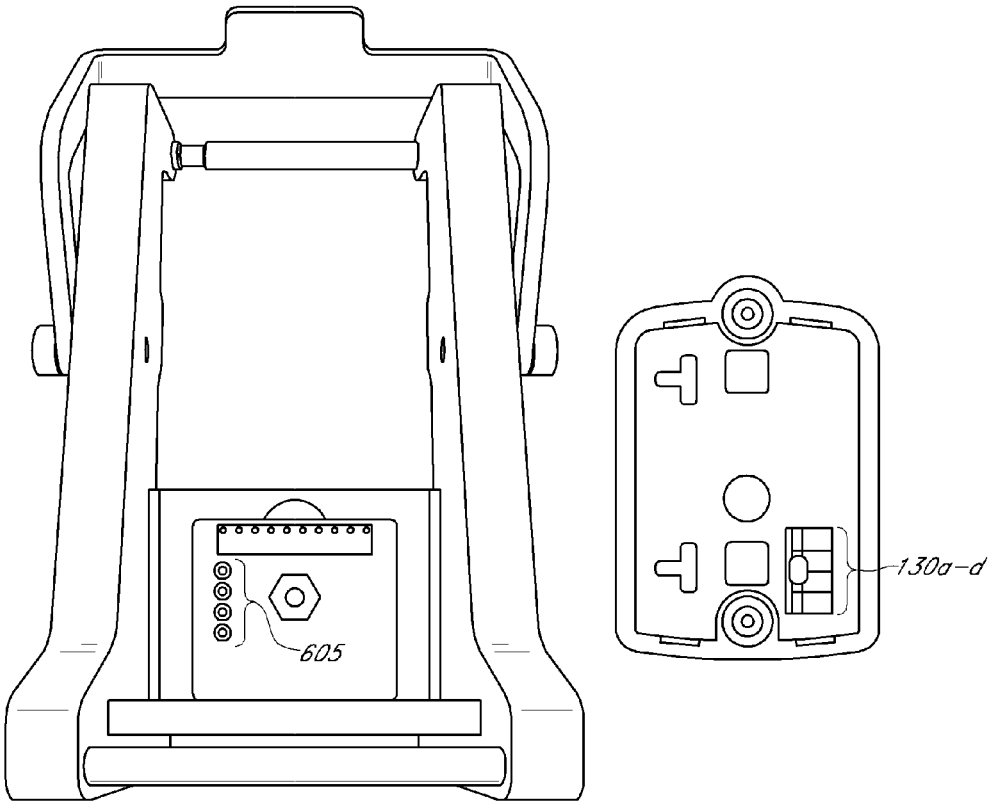

Moving to block 220, the inkjet cartridge is coupled to an electronic or programming adapter 250, thereby providing one means by which the printer cartridge is electronically connected with the system. In one embodiment, the adapter 250, as shown in FIGS. 6A-6C, is unique to each family or series of printer cartridges. In other embodiments, the adapter 250 has a series of adjustable features that allow it to fit a variety of inkjet cartridges regardless of the family or series of inkjet cartridge. In other embodiments, there is no electronic programming adapter and the generic configurable Smart-chip is, either before or after being attached to the cartridge, directly connected to the refilling system 10 by the operator of the refilling system 10. The cartridge will generally snap in or otherwise be secured to the electronic programming adapter or directly to the refilling system 10 such that the configurable generic Smart-chip is properly connected electrically to the refilling system's controller. In another embodiment, the cartridge is manually held into place during the configuration of the Smart-chip. As mentioned above, views of the adapter 250 are shown in FIGS. 6A-6C and are described in detail, below.

Moving to block 223, the inkjet cartridge is coupled to the Smart-chip programming station 12. The various family or series adapters 250 provide a common interface to the Smart-chip programming station within the system 10, and also among a variety of inkjet cartridge configurations. This common interface is explained in greater detail, below. Once coupled to the Smart-chip programming station 75, instructions programmed in the system can be executed via the controller or processor on the system and directed to the Smart-chip 120. In one embodiment, the instructions are stored on a memory residing within the Smart-chip programming station 75. In other embodiments, the computer executable instructions are stored in memory of the refilling system 10. The data sent to the Smart-chip can range in different embodiments from simple configuration data by sending only a few bits of information to a full download of the entire program or code required for the Smart-chip to function properly.

In one embodiment, the programming station 75 begins executing instructions as soon as the cartridge is detected. In another embodiment, the programming station 75 does not start processing until the user initiates processing via the graphical user interface.

Figure 4:
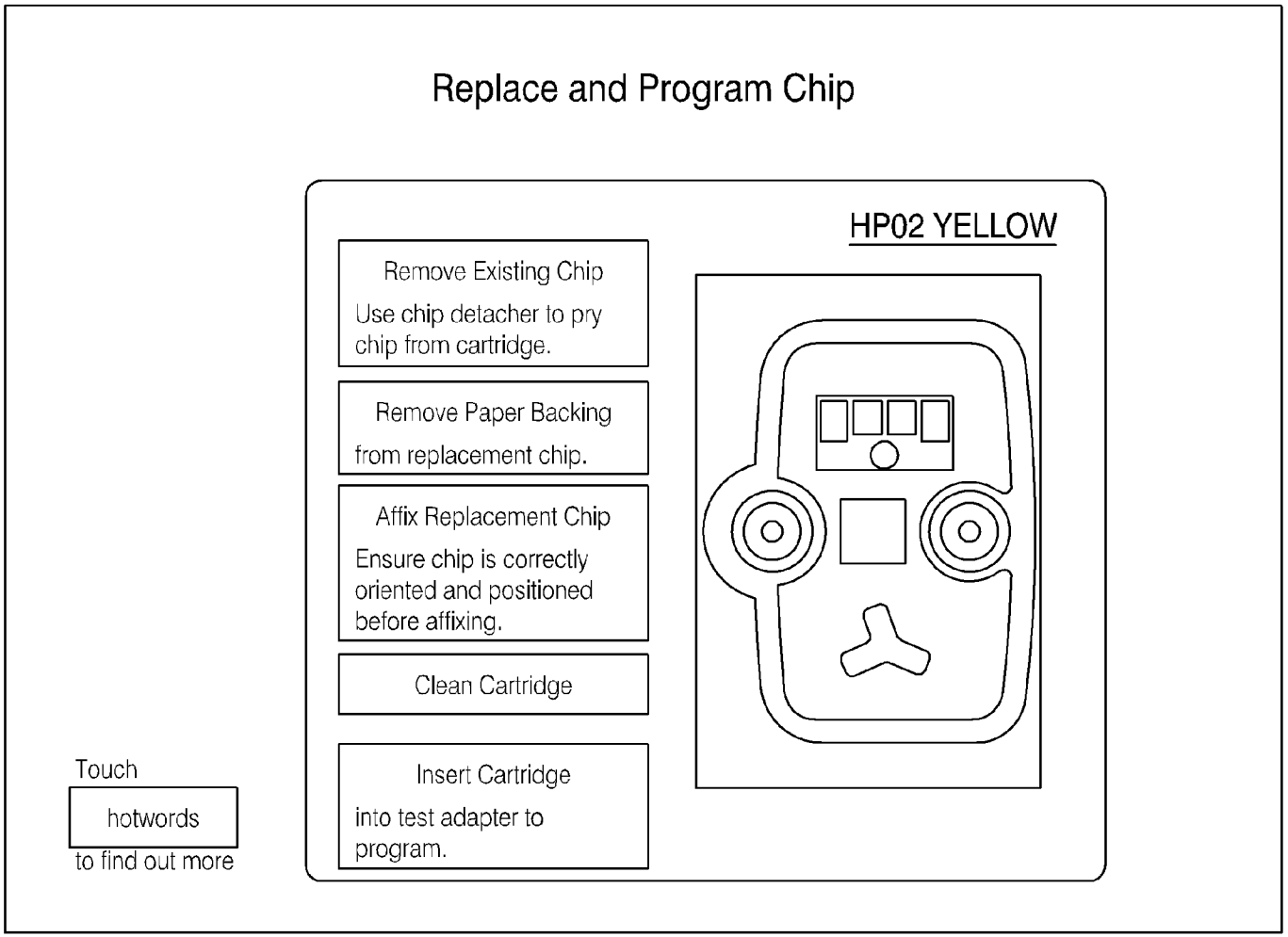
FIG. 4 is a view of an example message displayed on the Smart-chip programming station user interface.

At block 225, software instructions running at station 75 examine the Smart-chip 120 to verify that the Smart-chip has not yet been configured and therefore can be programmed. The programming station 75 connects electrically to the generic Smart-chip via the connections 130*a-d*, which can be secured on the cartridge. The station 75 verifies, through software executing instructions via a processor on the refilling machine or in the electronic programming station, that the new configurable generic Smart-chip has yet to be configured with regard to data indicative of the configuration of the Smart-chip. If the Smart-chip has already been configured or else is otherwise faulty or unable to be configured, the machine will notify the user, for example, by the Smart-chip programming station 75 display interface 70 shown in FIG. 4. FIG. 4 shows one embodiment of the message that would be shown to the user to explain the steps required to configure a Smart-chip. The screen is titled, for example "Replace and Program Smart-chip" to identify the task that the Smart-chip programming station 75 is currently performing. The screen displays the steps that the operator or user must take to complete the configuration process. For example, in the instance illustrated by FIG. 4, the operator is instructed to first remove the existing Smart-chip, then to remove the paper backing from replacement Smart-chip, then to affix the replacement Smart-chip, then to clean the cartridge, and finally to insert the cartridge into the test or programming adapter.

At block 227, the Smart-chip 120 has been verified as ready to be programmed. The station 75 receives the inkjet cartridge via a receiver 78 adapted to mate with the station 75 of the system 10 and provides an electrical connection from the system to the configurable Smart-chip on the inkjet cartridge, either directly or via an adapter mechanism. The receiver 78, in this embodiment, serves as connecting means and is electrically connected to the configuration station 75 within the system 10. When the adapter is mounted into the receiver, the contacts 130*a-d* make an electrical connection with contacts in the receiver and thereby provide a means for electrically connecting the inkjet cartridge 100 (and thus the Smart-chip) to the system 10.

Figure 5:
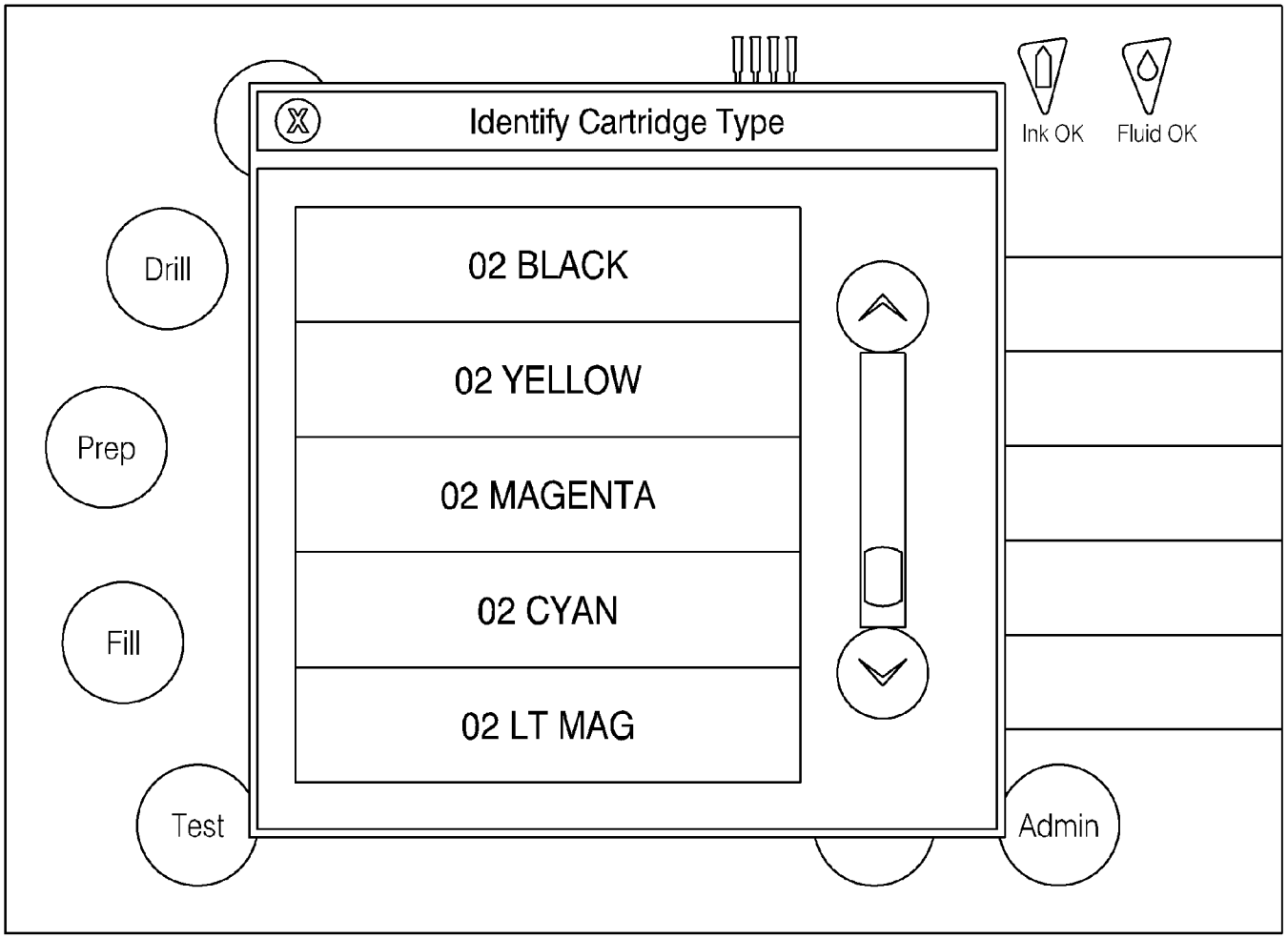
FIG. 5 is another embodiment of a graphical user interface to the inkjet printer cartridge Smart-chip programming station.

The user interface screen shown in FIG. 4 now allows the operator to enter a specific configuration desired for the required Smart-chip SKU and thus configuring the Smart-chip for use in a particular inkjet cartridge SKU, as demonstrated in FIG. 5. The station 75 executes programmed instructions, displays data indicative of the possible Smart-chip SKU configurations and then the configuration data for the chosen configuration is sent to the Smart-chip.

At step 230, the Smart-chip 120 is configured. As outlined above, generally, a unique set of programmed instructions is communicated to the generic configurable Smart-chip, thus configuring that Smart-chip for use with one particular inkjet cartridge SKU. In one embodiment, the Smart-chip contains a certain amount of basic, generic data specific for a particular cartridge family or series. In other embodiments, the Smart-chip has little or no stored data and the configuration step consists of downloading a more complete data set to provide for full Smart-chip functionality and configuration. The specific Smart-chip SKU information, that is, the data indicative of the cartridge's color, ink volume, size and/or type, is transmitted to the Smart-chip on the inkjet cartridge using a methodology that can be unique to each Smart-chip manufacturer. This data, after downloaded to a generic configurable Smart-chip, allows the Smart-chip to respond correctly to the various queries of the inkjet cartridge by the inkjet printer about the inkjet cartridge's type, size, color, ink level, etc. In one embodiment, this Smart-chip SKU configuration information is a binary code. In other embodiments, this Smart-chip SKU configuration information is sent via ASCII, hexadecimal, or other communication schema.

As used herein, the term "Smart-chip" means any programmable storage that can be programmed by a user and maintains persistent storage without external power. For example, in one embodiment, the Smart-chip generally takes the form of a small PCA or flexible electronic circuit that may, among other components, contain an application specific integrated circuit (ASIC) and/or an erasable programmable read only memory (EPROM) or the like. These and other well-known forms of computer memory do not lose their contents when the power supply is removed, and can be easily erased and reused. EPROMs and the like are generally employed for programs designed for repeated use (such as a computer's Buffered Input/Output system (BIOS) but can be upgraded with a later version of the program or other data. ASICs are highly customized electronic circuits that perform a very specific function. In other embodiments, flash memory or a one-time programmable EPROM may be used. However, any type of Smart-chip with persistent programmable memory may be suitable for the uses described herein.

The power and ground pins, if required, are used to connect electrical power to the Smart-chip. The Smart-chip Select pin(s), if provided, is used to tell the Smart-chip that it should wake up. The Serial-In pin(s), if provided, is used to send data to the Smart-chip. The Serial Out pin(s), if provided, is used by the Smart-chip to send data back to the controller from the Smart-chip. The Data Clock(s) pin, if provided, provides data to the Smart-chip regarding how fast the user wants data to be stored or retrieved. In one embodiment, due to the generally small amount of data that is stored and retrieved by the Smart-chip, transfer speeds are not a critical element of the design.

In one embodiment, the data array of a memory cell included in each of the storage elements of the Smart-chip is determined in such a manner that data indicative of the printer cartridge is stored most efficiently for Smart-chip processing. For instance, if the Smart-chip has certain basic-function data pre-stored on the Smart-chip, this may be written to an area of memory that is permanent and non-programmable. The memory must be non-volatile such that the data remains even when there is no power to the Smart-chip. Thus, the Smart-chip may have programmable storages that can be modified, and Read Only memory storages that cannot be programmed by a user.

A sample sequence to be programmed to the Smart-chip is shown below in Table 1, wherein three bits are used to store data required by the printer to properly recognize the refilled cartridge so that the refilled cartridge is operable within the printer. In one embodiment, the stored program might include some or all of the following elements:

TABLE 1

| | Type of Cartridge | Size of cartridge | Color of ink | Reset of Ink Level | Handshake data for particular manufacturer | Prog. Instruct. | Validation step | Misc. Info. |
|---|---|---|---|---|---|---|---|---|
| Cartridge 1 | 001 | 010 | 110 | 101 | 100 | 101 | 010 | 000 |
| Cartridge 2 | 010 | 111 | 010 | 101 | 001 | 110 | 001 | 101 |

Of course it should be realized that Table 1 is just an example of one set of data that can be stored in the generic programmable Smart-chip and that embodiments of the invention are not limited to a particular configuration of data or Smart-Chip. For example, each aftermarket replacement Smart-chip manufacturer may establish its own, unique sequence to customize a generic Smart-chip into a SKU-specific Smart-chip. Following programming, the replacement Smart-chip's memory would be accessible such that the printer can access the Smart-chip in the same way as is used when a new inkjet cartridge is purchased directly from the Original Equipment Manufacturer (OEM), including for example, that the ink level or other form of usage data may be updated periodically by the printer during the life of the cartridge.

In one embodiment, in general, the technological measure, or authentication sequence, requires a "secret handshake" between the printer and the Smart-chip on the inkjet cartridge to enable printer functionality. The measure involves calculations by, and communications between, the printer and the inkjet cartridge. This communication can take place, among other times, each time a cartridge is installed in the printer, when the printer is powered on, when data is sent to a cartridge to affect printing, or whenever the printer is opened and then closed. Both the printer and the Smart-chip can employ an encryption algorithm which calculates an identifying code or other proprietary enabling sequence. In one embodiment the encryption algorithm is publicly available. In other embodiments, the encryption algorithm is proprietary and kept secret by the inkjet cartridge OEM. In most cases, this code is a proprietary code. In one embodiment, both the printer and the Smart-chip on the cartridge calculate a code referred to as a Message Authorization Code (MAC). The Smart-chip then communicates its calculated MAC to the printer. If the MAC calculated by the Smart-chip matches the MAC calculated by the printer, the printer recognized the inkjet cartridge as being authorized and printer functionality and access to programs such as programs that control ink loading and the printer engine program are enabled.

By design, unless this authentication sequence or "secret handshake" takes place successfully, the printer will not recognize the inkjet cartridge as being an authorized inkjet cartridge, and the printer will not print. The technological measure therefore prevents access to a number of programs that run on the printer and does not allow the printer to print using the inkjet cartridge.

In one embodiment, the Smart-chip programming station 75 causes data indicative of the inkjet cartridge specific SKU configuration, as well as any printer specific configuration, programming or security information to be written to the replacement Smart-chip. In one embodiment, this data stream is similar to the data stream shown in Table 1, above. The inkjet cartridge then responds to queries by the printer with the correct and expected information for that inkjet printer. For example, referring to Table 1, the printer may query the Smart-chip of each cartridge as to the type, size and/or color of cartridge that has been installed, for example, an HP02 cartridge of regular size of the color cyan. The printer may also verify that the cartridge has ink or other ink usage related data. Each OEM will likely have its own unique handshake data sequence with regard to its cartridges and their communication with the printer software. In one embodiment, this handshake data sequence is reverse-engineered so that it can be stored onto the generic programmable Smart-chip. Further, making that Smart-chip solution capable of being customized to one of many configurations, validates the cartridge to the printer and enables the process and methods of this invention. Once the inkjet printer Smart-chip 120 is programmed with the configuration information and the inkjet cartridge data is verified or validated, and the cartridge is refilled, then the inkjet cartridge is ready to be reinstalled into the inkjet printer.

Figure 7:
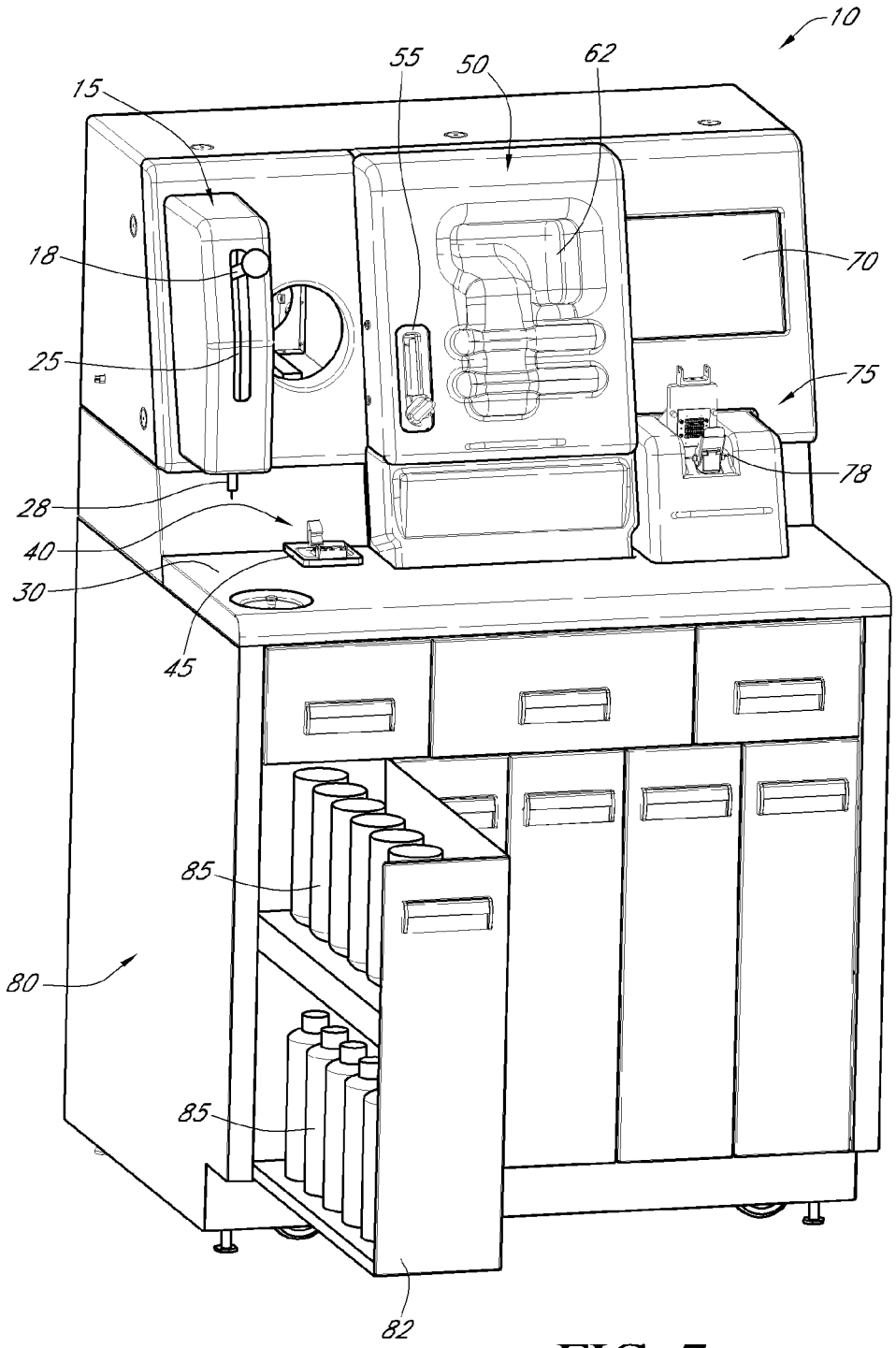
FIG. 7 depicts one embodiment of an inkjet refilling system.

At step 235, the cartridge is removed from the programming module and can be then inserted into another station in the refilling machine 10, for example, for refilling of ink. An embodiment of the refilling system 10 is shown in FIG. 7 and described herein. In one embodiment, the user does not have to change adapters between refilling and programming test stations. As mentioned above, the step 235 can be performed at the beginning or the end or in the middle of the Smart-chip configuration process 200.

Adapters

In one embodiment, the system 10 is a modular ink refilling system that comprises a set of fixtures or adapters that mate to receivers at each station of the system. As used herein, the term "fixture" and the term "adapter" are used interchangeably. One embodiment of such an adapter is illustrated in FIGS. 6A-C. In one embodiment, each fixture is designed to hold a particularly shaped and sized inkjet printer cartridge for use within the system. Accordingly, the inkjet printer cartridge, when placed within the adapter can be mated to a receiver at a station of the system. Through the use of the receivers, the system can provide a unified receiver interface to each fixture, and each fixture can be designed to hold a particular configuration of cartridge. As new cartridges are developed, additional fixtures can be manufactured to hold the cartridge and mate with the receivers. This thereby allows the system to refill newly designed cartridges without resorting to alterations in the system.

Each fixture may provide a pair of vertically oriented side support surfaces connected to one another by a back surface. Perpendicular to and disposed between upper portions of the support surfaces is a moveable top surface that swings from an open position to a closed position. In the open position, a cartridge can be introduced into the fixture, whereas in the closed position, as shown in FIGS. 6A and 6, the cartridge is locked into the fixture. Alternately, a spring mounted to the back surface may be used to secure the cartridge into the fixture. A lower surface of the fixture may be open so that the nozzles from the inkjet cartridge are exposed for processing in the system. Additionally, the rear section of the inkjet printer cartridge may be exposed through the back of the fixture so that the electronic connections provided thereon As illustrated in one embodiment shown in FIGS. 6A and 6C, the fixture comprises electrical connections so that it can communicate electronically with receivers in the system. Thus, when a cartridge is mounted into a fixture, the rearward section of the fixture comprises a series of contacts 605 that are positioned to connect to the contacts 130*a-d* on the rear portion of the cartridge, and thus to the Smart-chip. The outer back portion of the fixture is designed to provide a standard interface 604 to a receiver so that no matter which fixture is placed within the receiver, the contacts 605, 130*a-d* are in the same position. This allows the system to control a plurality of cartridges, but only have one interface on the system.

By electrically connecting the cartridge to a receiver on the system, the nozzles on the inkjet cartridge may be fired as part of a functional test to ensure that the cartridge is working after it has been refilled or a Smart-chip may be configured or otherwise programmed. For example, in one embodiment, the system includes a testing receiver that is adapted to electrically connect to the fixtures and run one or more test routines designed to test functionality of the cartridges. These tests may be printed onto paper that is then reviewed by the operator, or the system may directly test the function of a Smart-chip.

In one embodiment, each of the different fixtures contains a unique code that is recognized by the system 10 so that it can properly fill the cartridge that is being held within the fixture. In one embodiment, a plurality of magnets can be placed in the bottom of the fixture. The system 10 can then be provided with magnetic sensors which determine which of the magnets are present on a particular fixture. By determining the positions of the magnets on a particular fixture, the system can determine the fixture type, and therefore the cartridge type that is being refilled. As shown, in this embodiment, eight magnetic positions are shown. Thus, each fixture could provide a unique set of magnets within these eight locations.

Of course, it should be realized that embodiments of the invention are not limited to only magnetic coding of fixtures. Any type of coding which allows the system to uniquely recognize each type of fixture is contemplated. For example, the system may use a bar code, magnetic field identifier (MFID), or a radio frequency identifier (RFID) on each fixture and then determine the type of fixture from that information.

It should be noted that embodiments of the invention are not limited to the use of fixtures. In some embodiments, the cartridge may directly mate to a receiver at a station on the system and thereby be processed. For example, in one embodiment an inkjet cartridge is mounted directly into a programming station within the system.

Figure 6E:
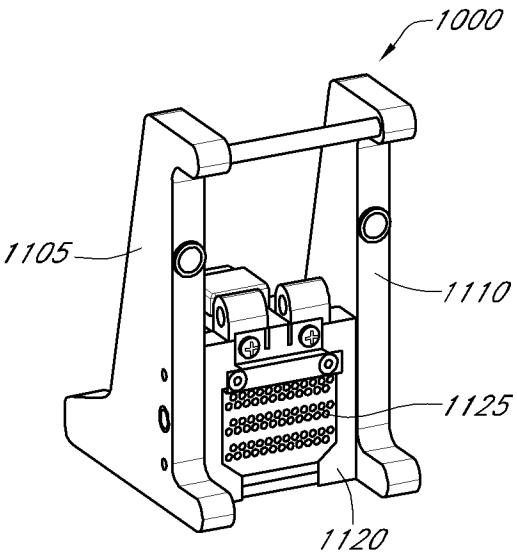
FIGS. 6D and 6E provide a perspective view of another embodiment of a programming and/or test adapter.
Figure 6D:
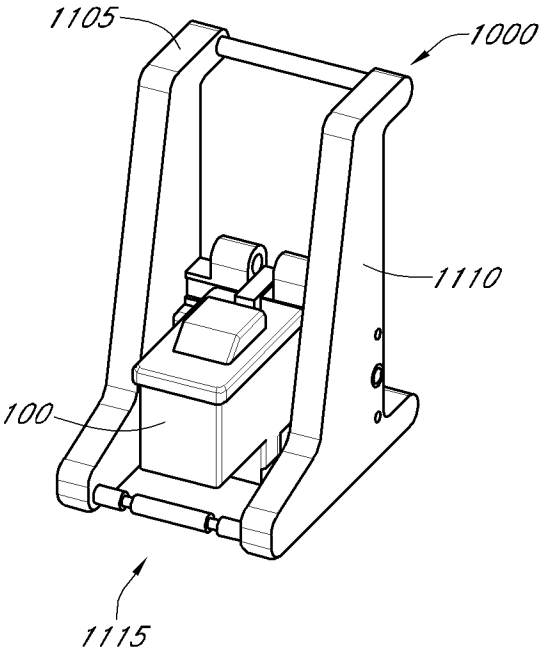

FIGS. 6D and 6E provide a perspective view of another embodiment of a test fixture. The fixture 1000 comprises two side supports 1105, 1110 connected by a rear surface 1120. The bottom of the test fixture is open so that the nozzles of the cartridge 100 are exposed below the fixture for printing. A rear surface 1120 includes two sets of contacts for connecting the cartridge to the system. An interior portion (not shown) of the rear surface 1120 provides an electrical interface configured to mate with the electrical interface or Smart-chip of the inkjet cartridge 100. The exterior portion of the rear surface 1120 provides an electrical interface configured to mate with a set of contacts in the test receiver or Smart-chip programming station 78. Thus, when the cartridge 100 is placed into the test fixture 1000, the electrical interface of the cartridge makes an electrical connection with the contacts on the interior portion of the rear surface 1120. Similarly, when the fixture 1000 is mounted into the receiver 78, the contacts 1125 make an electrical connection with contacts in the receiver 78 and thereby provide a means for electrically connecting the cartridge 100 to the system 10. Further, by electrically connecting an inkjet cartridge which contains a configurable Smart-chip, through a suitable adapter to the receiver on the system, an efficient and upgradeable system is established to program the configurable Smart-chip.

In some embodiments, each of a plurality of different fixtures 1000 configured to mate with a specific configuration of inkjet cartridge contains a unique identifier code that is recognized by the test system so that it can properly control the print nozzles of the cartridge that is being held within the fixture. The unique identifier can be similar to the fixture where a plurality of magnets can be placed in the bottom of the fixture 1000.

The Inkjet Filling System

Referring now to FIG. 7, an inkjet refilling system 10 is shown. The system shown is a floor-standing unit, but other configurations (e.g., a desk-top unit) are also within the scope of the invention. The system includes a drill station 15 having an actuator 18. In the embodiment shown, the actuator 18 comprises a handle on a lever. In this embodiment, an on/off switch activates the drill. Thus, when the lever is moved downward, the drill becomes active. A slide channel 25 allows the actuator to slide up and down as the drill is engaged with a cartridge.

A covered self-centering drill bit 28 protrudes from the lower portion of the drill station, and is connected to the actuator 18 so that movement of the actuator 18 within the slide channel 25 results in the covered drill bit 28 moving up and down.

Beneath the covered drill bit 28 is a flat surface 30 where fixtures are placed containing cartridges to be drilled. Examples of particular fixtures are discussed in detail below. Once a fixture has been placed on the flat surface 30 and aligned beneath the drill bit 28, any of several on/off switches, known in the art, can be used to activate the self-centering drill bit 28. The actuator 18 is then slid down within the slide channel 25 until the drill bit 28 drills a hole within the cartridge. In one alternative embodiment, the drill mechanism may be configured such that the drill activates and begins to spin the drill bit as soon as the handle is lowered from the top of the spring-biased upper position in the slide channel 25.

Adjacent the drilling station 15 is a cleaning station 40 which is configured to receive an inkjet printer cartridge and remove any excess ink from the cartridge prior to refilling. In this embodiment, the cleaning station 40 includes a mounting station 45 which is adapted to receive the plurality of the fixtures described above. A portion of the mounting station 45 includes an evacuation station that communicates with a vacuum source in order to evacuate the ink from any cartridge that is inserted into the mounting station 45.

Within a central portion 50 of the system 10 is a nozzle refilling station 55 that is configured to receive an inkjet cartridge and refill that cartridge through its nozzles. As is known in the art, inkjet printer cartridges eject ink from a set of nozzles. In some cases it is possible to refill or clean inkjet cartridges by forcing ink or cleaning solutions into the cartridge through the nozzles. One example of such a cartridge is the Hewlett Packard Model HP45 inkjet printer cartridge. When the cartridge is placed within the nozzle refilling station 55, the system forces a predetermined quantity of ink into the cartridge through the nozzles. In one embodiment, the nozzle refilling station 55 also includes a vacuum source so that prior to nozzle filling the inkjet cartridge it can be evacuated to remove any unused ink. In this manner the system knows the proper amount of ink to use in refilling the cartridge. In another embodiment, the nozzle refilling station 55 includes a wash solution source that can be used to rinse the interior of the cartridge prior to refilling. Wash solution may include sterile filtered water, or a cleansing solution adapted for cleaning inkjet cartridges.

Adjacent the central portion 50 is a control interface 70 which is used by the operator to control each step in the refilling process. In one embodiment, the control interface comprises a touch screen graphical user interface. The control interface is linked to a central computer system (not shown) that controls all of the functions of the system 10. By inputting commands through the interface 70, an operator can perform the functions described herein.

Below the interface 70 is a test station 75 which includes a test fixture or receiver 78 for holding a cartridge fixture or adapter. The test station 75 is used to test each cartridge after it has been refilled and thereby ensure that it is functioning properly before it is re-installed into a printer.

Within a lower portion 80 of the system 10 is a drawer 82 that provides a series of ink refill bottles 85. These bottles provide the source of ink used within the system to refill the inkjet cartridges.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being redefined herein to be restricted to including any specific characteristics of the features or aspects of the invention with which that terminology is associated. The scope of the invention should therefore be construed in accordance with the appended claims and any equivalents thereof.

What is claimed is:

1. A system for refilling an inkjet cartridge, the system comprising:

a first station configured to refill an inkjet cartridge;

a second station configured to electrically connect to a configurable Smart-chip on the inkjet cartridge, wherein the configurable Smart-chip can be configured to work properly with a plurality of inkjet cartride types; and programmed instructions that when executed receive the type of inkjet cartridge to configure, and store inkjet cartridge configuration data that is proper for the type of inkjet cartridge being configured on the configurable Smart-chip via the second station.

2. The system of claim 1, wherein the programmed instructions are configured to validate the configuration data stored on the configurable Smart-chip.

3. The system of claim 1, wherein the second station is configured to electrically mate with an adapter that holds the inkjet cartridge.

4. The system of claim 3, wherein the system comprises a receiver adapted to electrically mate with the adapter and provide an electrical connection from the system to the configurable Smart-chip on the inkjet cartridge.

5. The system of claim 3, wherein the adapter comprises an open slot configured to receive one or more cartridges.

6. The system of claim 1, wherein the second station is configured to electrically mate directly to the inkjet cartridge.

7. The system of claim 1, wherein the system comprises a graphical user interface configured to receive inputs from a user to determine the specific configuration requirements for the cartridge and a controller configured to execute the programmed instructions.

8. The system of claim 1, wherein the inkjet cartridge configuration data comprises data indicative of at least one of the size, color and type of inkjet cartridge.

9. The refilling system of claim 1, wherein the second station automatically starts when the cartridge is detected.

10. The system of claim 1, wherein the first station comprises a plurality of ink supply needles.

11. The system of claim 1, wherein the first station comprises a vacuum chamber.

12. A configuration system for printer cartridges, the system comprising:

one or more adapting means for electrically connecting to a printer cartridge, each of the adapting means configured to electrically connect to a Smart-chip on a printer cartridge and wherein each cartridge includes a Smart-chip that is configurable to one of multiple possible configurations;

receiving means for electrically connecting to the one or more adapting means, wherein each of the adapting means is configured to be individually mounted into and demounted from said receiving means; and means for configuring said Smart-chip to one of the possible configurations by altering the data on the Smart-chip to comprise the proper at least one of size, color, and type of cartridge based on the type of printer cartridge electrically connected to said adapting means.

13. The system of claim 12, further comprising a validating means for confirming the configuration of the Smart-chip.

14. The system of claim 12, wherein the adapting means comprises an adapter configured to mate with one or more printer cartridges.

15. The system of claim 14, wherein the adapting means is configured to provide an electrical connection from the system to the Smart-chip.

16. The system of claim 12, wherein the adapting means comprises an open slot configured to receive one or more cartridges.

17. The system of claim 12, wherein the receiving means comprises a receiver configured to receive the adapting means.

18. The system of claim 12, wherein the means for configuring said Smart-chip comprises electronics connected to the receiving means.

19. The system of claim 12, wherein the configuration system comprises means for displaying a graphical user interface to receive inputs from a user.

20. The system of claim 19, wherein means for displaying is adapted to receive specific configuration requirements for the printer cartridge.

21. The system of claim 20, wherein the configuration system comprises a means for executing programmed instructions.

22. The system of claim 12, wherein the configuration system comprises a means for detecting when the cartridge is connected to the configuration system.

23. The system of claim 22, wherein the configuration system automatically configures said Smart-chip when the detecting means has detected when the cartridge is connected to the configuration system.

24. A method for refilling an inkjet cartridge, the method comprising:

refilling a type of inkjet cartridge with ink at a first station;

electrically connecting to a configurable Smart-chip on the inkjet cartridge via a first station; and executing programmed instructions to obtain configuration data based on the type of inkjet cartridge that was refilled in the first station and then configuring the configurable Smart-chip.

25. The method of claim 24, further comprising validating the configuration of the configurable Smart-chip.

26. The method of claim 24, further comprising mating the first station with an adapter that holds the inkjet cartridge.

27. The method of claim 26, further comprising adapting a receiver to mate with the adapter and provide an electrical connection from the system to the configurable Smart-chip on the inkjet cartridge.

28. The method of claim 24, further comprising receiving the instructions via a graphical user interface.

29. The method of claim 24, wherein the inkjet cartridge configuration data comprises data indicative of at least one of the size, color and type of inkjet cartridge.

30. The refilling method of claim 24, further comprising automatically starting the first station when the cartridge is detected.

31. The method of claim 24, wherein the inkjet cartridge configuration data comprises data indicative of at least the size, color and type of inkjet cartridge.

32. The method of claim 24, further comprising mating the first station with the inkjet cartridge directly.

* * * * *

UNITED STATES PATENT AND TRADEMARK OFFICE

CERTIFICATE OF CORRECTION

PATENT NO. : 8,602,536 B1
APPLICATION NO. : 12/940013
DATED : December 10, 2013
INVENTOR(S) : Herb Sarnoff It is certified that error appears in the above-identified patent and that said Letters Patent is hereby corrected as shown below:

In the Claims

Column 15, Line 59 of Claim 1, change “cartride” to --cartridge--.

Signed and Sealed this
Twenty-sixth Day of August, 2014

Michelle K. Lee

Michelle K. Lee
*Deputy Director of the United States Patent and Trademark Office*